US008310438B2

(12) United States Patent
Shishido et al.

(10) Patent No.: US 8,310,438 B2
(45) Date of Patent: Nov. 13, 2012

(54) IMAGE DISPLAY DEVICE WITH GAIN CALCULATOR AND OVERDRIVE UNIT

(75) Inventors: Tomoyuki Shishido, Yokohama (JP); Hideki Aiba, Yokohama (JP)

(73) Assignee: JVC Kenwood Corporation, Yokohama-shi, Kanagawa (JP)

( * ) Notice: Subject to any disclaimer, the term of this patent is extended or adjusted under 35 U.S.C. 154(b) by 399 days.

(21) Appl. No.: 12/654,887

(22) Filed: Jan. 7, 2010

(65) Prior Publication Data

US 2010/0214330 A1 Aug. 26, 2010

(30) Foreign Application Priority Data

Feb. 24, 2009 (JP) ..... P2009-040334

(51) Int. Cl.
*G09G 3/36* (2006.01)

(52) U.S. Cl. ..... 345/102; 345/99

(58) Field of Classification Search ..... 345/89, 345/102, 103, 87, 99, 606, 643
See application file for complete search history.

(56) References Cited

U.S. PATENT DOCUMENTS

2006/0267904 A1* 11/2006 Aiba ..... 345/98
2007/0216636 A1* 9/2007 Lo ..... 345/102
2008/0284719 A1* 11/2008 Yoshida ..... 345/102

FOREIGN PATENT DOCUMENTS

JP 2005-148521 A 6/2005
JP 2006-337448 A 12/2006
JP 2007-133051 A 5/2007

* cited by examiner

*Primary Examiner* — Chanh Nguyen
*Assistant Examiner* — Allison Walthall
(74) *Attorney, Agent, or Firm* — Nath, Goldberg & Meyer; Jerald L. Meyer; Robert T. Burns

(57) ABSTRACT

An image display device includes a gain calculator, a multiplier and an overdrive unit. The gain calculator calculates a ratio "Gmax0/Gmax1" as gain, with respect to each segmented region of liquid crystal panel. The symbol "Gmax1" represents a maximum gradation in one frame period of an image signal to be supplied to each segmented region. The symbol "Gmax0" represents a maximum gradation to be determined depending on the number of bits in the image signal. The multiplier multiplies an image signal subjected to frame frequency conversion in a frame frequency conversion unit by the gain to generate an image signal subjected to the area control processing, with respect to each segmented region. The overdrive unit emphasizes the image signal subjected to the area control processing, using an image signal generated by delaying the image signal subjected to the area control processing for one frame period.

2 Claims, 8 Drawing Sheets

IMAGE DISPLAY DEVICE WITH GAIN CALCULATOR AND OVERDRIVE UNIT

BACKGROUND OF THE INVENTION

1. Field of the Invention

The present invention relates to an image display device, and more specifically an image display device that has both of a function of area control for controlling a degree of light emitting luminance of a backlight according to luminance information in an image signal and a function of overdrive for reducing a blur of moving image, and displays an image using a liquid crystal display element.

2. Description of the Related Art

It has been proposed that an image display device displays an image using a liquid crystal display element at a frame frequency higher than a frame frequency of an input image signal to be converted into the high frame frequency, in order to improve moving image characteristics. In addition to the frame frequency conversion method, if an image signal is multiplied by an emphasis coefficient which is determined by a level difference between image signals of pixels in two adjacent frames on time axis, the moving image characteristics are further improved. The method for multiplying an image signal by the emphasis coefficient is generally called "overdrive".

However, when the image display device combines use of the frame frequency conversion method and the overdrive, the overdrive processing overloads the image display device as the frame frequency becomes higher. Further, the frame frequency becomes higher, which increases a speed of accessing a memory where the image display device writes or reads frame images to be used for comparing at least two adjacent frames in the overdrive processing.

In order to resolve the above-described problems, there has been known an image display device in which a speed of accessing a memory or processing a signal is the same as one in a device in which a frame frequency is not converted into a higher frame frequency, by building an overdrive unit into an image signal processing unit into which an image signal is input before a frame frequency of the input image signal is converted into a high frame frequency. For example, this image display device is disclosed in Patent document 1 (Japanese Published Unexamined Application NO. 2006-337448). According to the conventional image display device, a memory, which is prepared for carrying out the overdrive processing after a frame frequency of the input image signal is converted into a high frame frequency, can be eliminated from the image display device by using frame data for detecting motion information and generating increment frames in the overdrive unit to carry out the overdrive processing.

In addition to the improvement in moving image characteristics, as a method for improving power consumption and contrast in an image display device provided with a backlight such as a liquid crystal display device, there has been known an image display device that divides each frame of a still image or moving image into a certain area, individually controls a backlight and an image signal level based on characteristics by area, and displays the still image or moving image thereon. For example, this image display device is disclosed in Patent document 2 (Japanese Published Unexamined Application No. 2007-133051). The improvement method in the conventional image display device provided with the backlight is called "area control".

However, in the image display device disclosed in Patent document 1, since a frame frequency conversion unit (time series conversion memory) is arranged on the stage subsequent to the overdrive unit (time axis emphasis circuit), if circuits for greatly changing an image signal level, such as an image signal processing unit for adjusting a gain of image signal and a backlight luminance control unit for adjusting an amount of light to be emitted from a backlight device which are disclosed in Patent document 2, are arranged on the stage subsequent to the frame frequency conversion unit, the emphasis by overdrive to be suitable for the level difference between image signals of original image is weakened by area control. This causes the emphasis by overdrive to be excessive or deficient, which affects a moving image response and/or a moving image quality. Hereinafter, a gain adjustment of an image signal in the image signal processing unit and a light amount adjustment of the backlight device in the backlight luminance control unit are called "area control".

For the overdrive processing, a response speed of a liquid crystal display element differs according to the degree of gradation change in a liquid crystal display device, which brings a difference of emphasis coefficient. Therefore, if an image signal which has been multiplied by an optimal emphasis coefficient in the overdrive unit is processed in an area control unit, there is a possibility that an emphasis by overdrive will be excessive or deficient. As a result, when an image of a captured object such as a car that moves at high speed is displayed, a fake contour occurs around a real contour of the captured object on the displayed image by excessive emphasis, or a blur of the captured object occurs by deficient emphasis.

SUMMARY OF THE INVENTION

The present invention is invented in order to resolve the above-described problems, and has an object to provide an image display device that improves moving image characteristics, contrast, and power consumption, and prevents a fake contour of object and a blur of moving image from occurring, by arranging an overdrive unit on the stage subsequent to an area control unit.

In order to achieve the above-described object, the first invention provides an image display device comprising: a liquid crystal panel that displays an image thereon based on an image signal; a backlight device that is mounted on a back side of the liquid crystal panel and segmented into plural regions, and has light sources for emitting light to the liquid crystal panel which are arranged on each region; a delay unit that delays a first image signal with a first frame frequency for one frame period to generate a second image signal; an interpolation image signal generating unit that generates one or plural interpolation image signals to be inserted between adjacent frames in the first image signal, using the first image signal and the second image signal; a frame frequency conversion unit that inserts the one or plural interpolation image signals between the adjacent frames in the first image signal to generate a third image signal with a second frame frequency higher than the first frame frequency; a gain calculator that calculates a gain based on a ratio of a maximum gradation in one frame period of the third image signal and a maximum gradation to be determined depending on the number of bits in an image signal, with respect to each region of the liquid crystal panel corresponding to the each region of the backlight device; a multiplier that multiplies the third image signal by the gain to generate the multiplied third image signal; and an overdrive unit that carries out processing for emphasizing the multiplied third image signal in a time axis direction, using a delay image signal generated by delaying the multiplied image signal for one frame period.

In order to achieve the above-described object, the second invention provides an image display device comprising: a liquid crystal panel that displays an image thereon based on an image signal; a backlight device that is mounted on a back side of the liquid crystal panel and segmented into plural regions, and has light sources for emitting light to the liquid crystal panel which are arranged on each region; a delay unit that delays a first image signal with a first frame frequency for one frame period to generate a second image signal; an interpolation image signal generating unit that generates one or plural interpolation image signals to be inserted between adjacent frames in the first image signal, using the first image signal and the second image signal; a gain calculator that calculates a gain based on a ratio of a maximum gradation in one frame period of the first image signal and a maximum gradation to be determined depending on the number of bits in an image signal, with respect to each region of the liquid crystal panel corresponding to the each region of the backlight device; a multiplier that multiplies the first image signal, the one or plural interpolation image signals and the second image signal by the gain to generate the multiplied first image signal, the multiplied one or plural interpolation image signals and the multiplied second image signal; an overdrive unit that carries out processing for emphasizing the multiplied first image signal and the multiplied one or plural interpolation image signals in a time axis direction, using the multiplied one or plural interpolation image signals and the multiplied second image signal adjacent to the multiplied first image signal and the multiplied one or plural interpolation image signals on time series, to generate a first image signal and one or plural interpolation image signal subjected to the emphasis processing; and a frame frequency conversion unit that inserts the one or plural interpolation image signals having been subjected to the emphasis processing between the adjacent frames in the first image signal having been subjected to the emphasis processing to generate an image signal with a second frame frequency higher than the first frame frequency.

In order to achieve the above-described object, the third invention provides the image display device according to the first or second invention, further comprising: a control unit that controls the light sources arranged on each region of the backlight device such that the light sources emit light at a light amount depending on an inverse of the gain calculated by the gain calculator with respect to each region of the liquid crystal panel corresponding to the each region of the back light device.

According to the present inventions, a circuit unit, which carries out the overdrive processing in which a rising edge of input image signal is emphasized in a time axis direction, is arranged on the stage subsequent to the gain and the multiplier which carry out the area control processing. This realizes to improve moving image characteristics, contrast, and power consumption, and prevent an unintended fake contour of object and a blur of moving image from occurring.

DESCRIPTION OF THE EMBODIMENTS

Exemplary embodiments of the present invention will be described below, with reference to FIGS. 1 to 9C.

First Exemplary Embodiment

Figure 1:
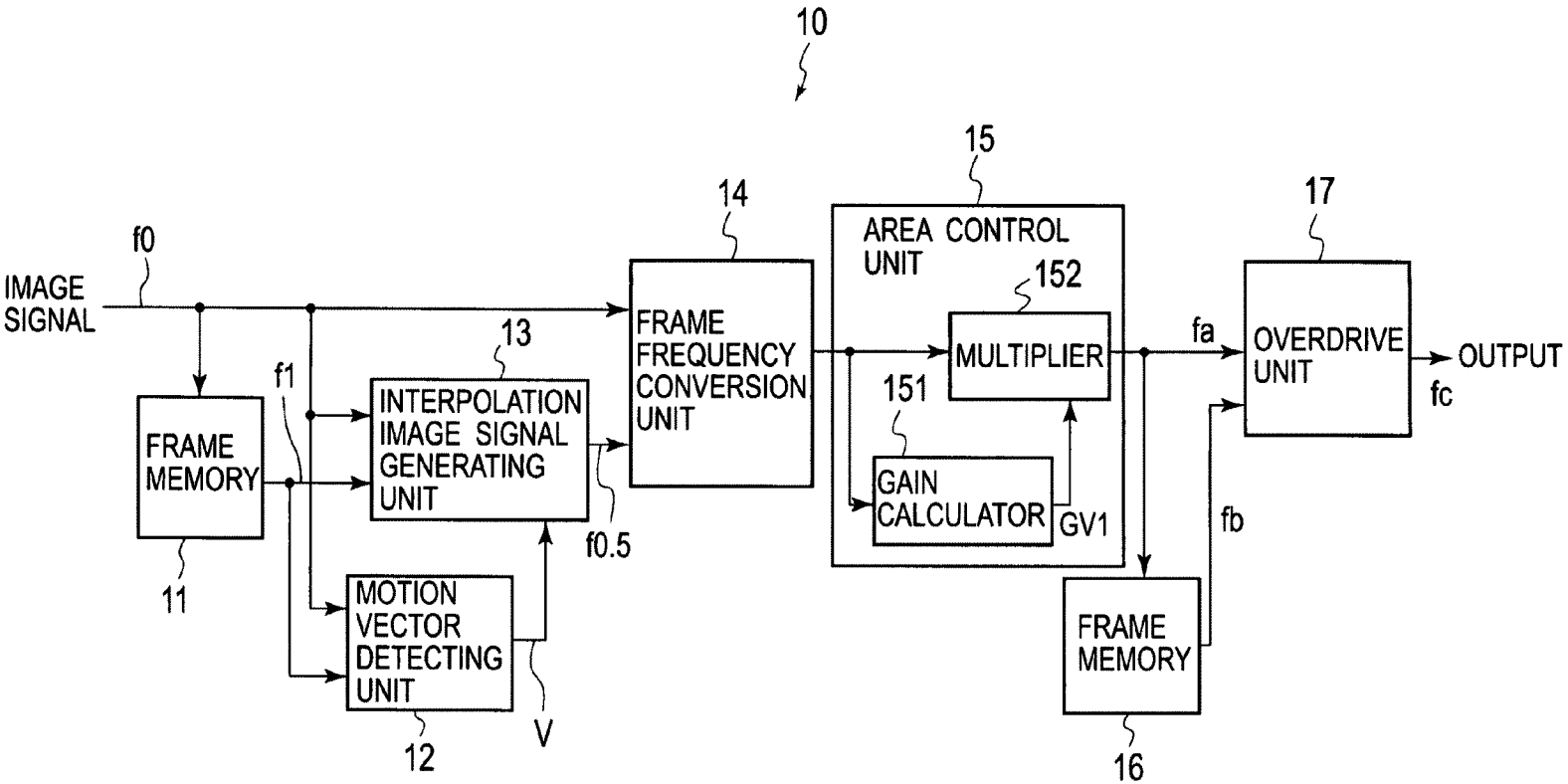
FIG. 1 is a block diagram of an image display device according to a first exemplary embodiment of the present invention.

FIG. 1 illustrates a block diagram of an image display device 10 according to the first exemplary embodiment. The image display device 10 includes a frame memory (delay unit) 11, a motion vector detecting unit 12, an interpolation image signal generating unit 13, a frame frequency conversion unit 14, an area control unit 15, a frame memory (delay unit) 16 and an overdrive unit 17. The frame memory 11 delays an input image signal f0 for one frame period. The motion vector detecting unit 12 detects a motion vector V of the input image signal f0. The interpolation image signal generating unit 13 generates an interpolation image signal f0.5. The frame frequency conversion unit 14 converts a frame frequency of the input image signal f0. The area control unit 15 carries out an area control with respect to an output signal from the frame frequency conversion unit 14. The frame memory 16 delays an output signal fa from the area control unit 15 for one frame period. The overdrive unit 17 carries out overdrive processing with respect to the output signal fa from the area control unit 15.

The image display device 10 is a liquid crystal display device provided with pixels arranged in matrix state and configured to send an output image signal from the overdrive unit 17 to an active matrix type liquid crystal panel (not shown), which holds an electric signal for a predetermined period by each pixel to carry out display, and then display an image on the liquid crystal panel. The pixels include liquid crystal display elements. A backlight device is mounted on a back side of the liquid crystal panel and has light sources for emitting light to the liquid crystal panel that are arranged on each corresponding segmented region.

Next, an action of the image display device 10 will be described with reference to FIGS. 2A to 2G. The frame memory 11 stores the input image signal f0 illustrated in FIG. 2A in frame, and then outputs to the motion vector detecting unit 12 and the interpolation image signal generating unit 13 a delay image signal f1 illustrated in FIG. 2B delayed for one frame period. It is noted that each integer "0", "1", "2", "3" or "4" assigned to each frame shown in FIGS. 2A and 2B represents a number (frame number) of corresponding frame.

The motion vector detecting unit 12 detects a motion vector V between adjacent frames using the conventional matching method based on the input image signal f0 and the delay image signal f1, and sends the detected motion vector V to the interpolation image signal generating unit 13.

Figures 2A, 2B, 2C, 2D, 2E, 2F, 2G:
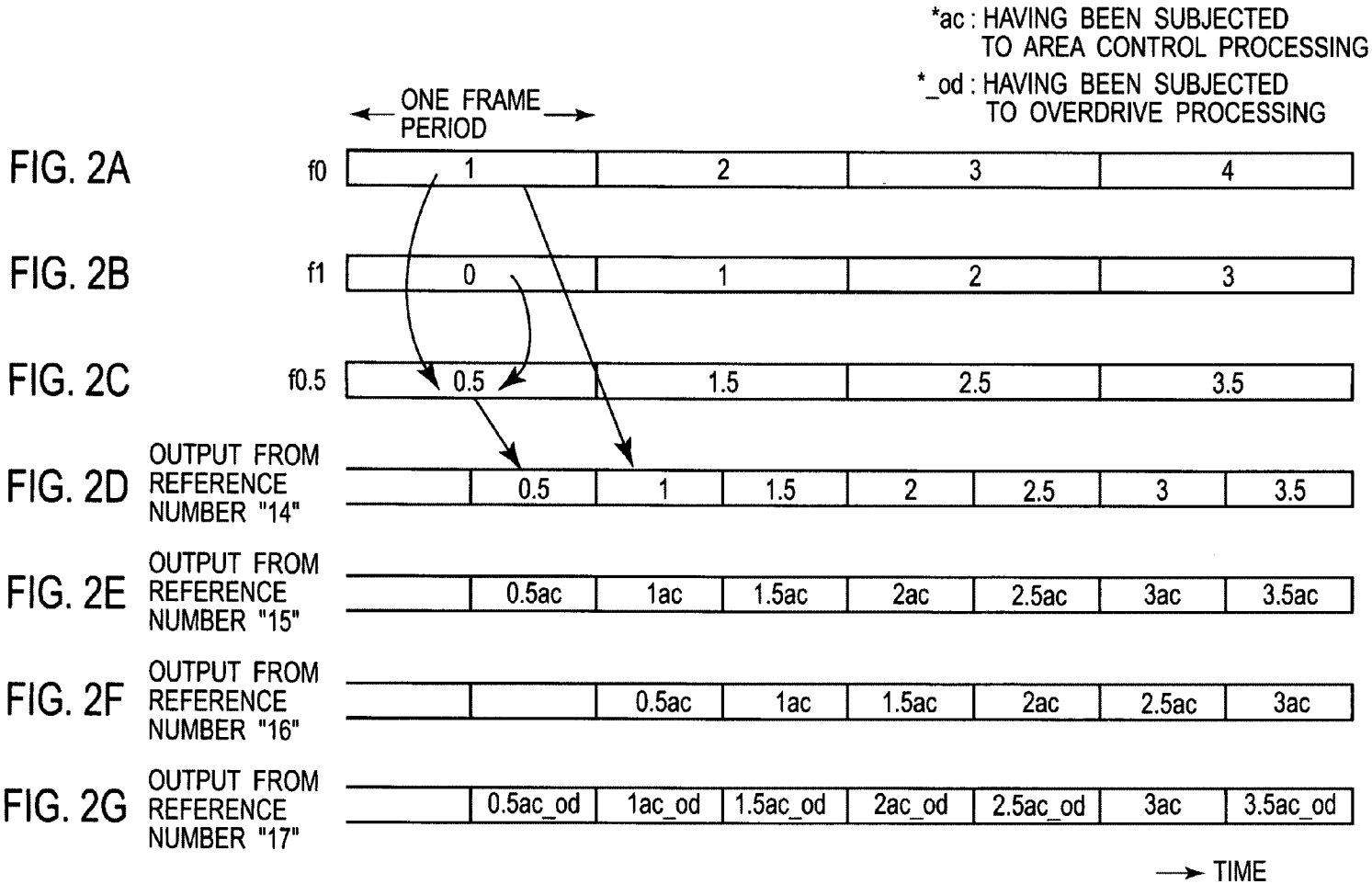
FIGS. 2A to 2G are timing charts to be employed to describe an action of the image display device shown in FIG. 1.

The interpolation image signal generating unit 13 carries out motion compensation interpolation processing with reference to the motion vector V to generate an interpolation image signal f0.5 illustrated in FIG. 2C based on the input image signal f0 and the delay image signal f1, and sends the generated interpolation image signal f0.5 to the frame frequency conversion unit 14. The interpolation image signal is an interpolation frame which, when the frame frequency conversion unit 14 on a stage subsequent to the interpolation image signal generating unit 13 doubles a frame frequency, is to be inserted into the intermediate on time axis between adjacent frames with the frame frequency prior to doubling. For example, an interpolation image signal f0.5 of a frame number "0.5" illustrated in FIG. 2C is an interpolation frame to be inserted between an input image signal f0 of a frame number "1" illustrated in FIG. 2A and a delay image signal f1 of a frame number "0" illustrated in FIG. 2B.

Here, the motion compensation interpolation processing carried out in the interpolation image signal generating unit 13 will be described in detail.

Figure 3A:
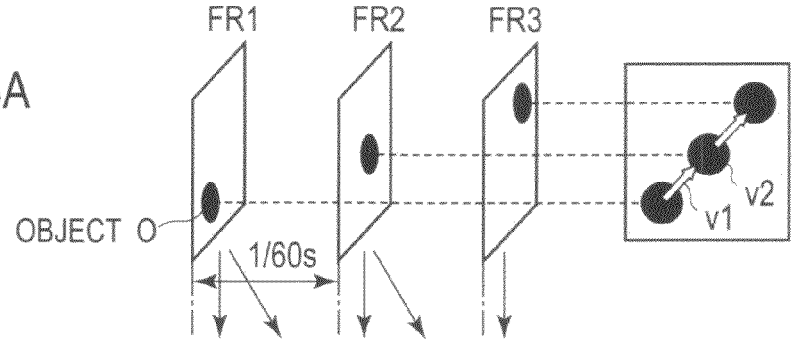
FIGS. 3A and 3B are explanatory diagrams to be employed to describe motion compensation interpolation processing in an interpolation image signal generating unit shown in FIG. 1.
Figure 3B:
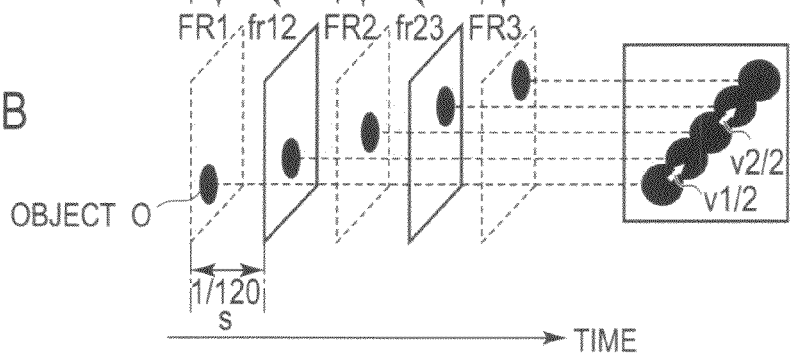

In a case where a conversion ratio of a frame frequency is double, the interpolation image signal generating unit 13 carries out vector transfer illustrated in FIGS. 3A and 3B as the motion compensation interpolation processing. FIG. 3A illustrates the input image signal f0 sent to the interpolation image signal generating unit 13 and numbers (frame numbers) "FR1", "FR2" and "FR3" of frames in the input image signal f0. FIG. 3B illustrates the interpolation image signal f0.5 generated in the interpolation image signal generating unit 13 and numbers "fr12" and "fr23" of frames in the interpolation image signal f0.5. It is noted that, in FIG. 3B, frames to which the frame numbers "FR1", "FR2" and "FR3" are assigned are drawn in dot-lines in positions where these frames are present on time axis. The frame, to which the frame number "fr12" is assigned and in which vector transfer is carried out, is inserted between the adjacent frames to which the frame numbers "FR1" and "FR2" are assigned. The frame, to which the frame number "fr23" is assigned and in which vector transfer is carried out, is inserted between the adjacent frames to which the frame numbers "FR2" and "FR3" are assigned.

A rightmost picture in FIG. 3A illustrates a trajectory on which an object O moves on the frames of the frame numbers "FR1", "FR2" and "FR3" in this order. In FIG. 3A, the object O moves from a position on the frame of the frame number "FR1" to a position on the frame of the frame number "FR2", which brings a motion vector v1 to appear, and then moves from the position on the frame of the frame number "FR2" to a position on the frame of the frame number "FR3", which brings a motion vector v2 to appear. A rightmost picture in FIG. 3B illustrates a trajectory on which an object O moves on the frames of the frame numbers "FR1", "fr12", "FR2", "fr23" and "FR3" in this order. Positions of the object O on the frames of the frame numbers "FR1", "FR2" and "FR3" in FIG. 3B are the same as the positions of the object O on the frames of the frame numbers "FR1", "FR2" and "FR3" in FIG. 3A. The object O moves from the position on the frame of the frame number "FR1" to a position on the frame of the frame number "fr12" along the motion vector v1 so that the distance between these positions is equal to a half magnitude of the motion vector v1. The object O moves from the position on the frame of the frame number "FR2" to a position on the frame of the frame number "fr23" along the motion vector v2 so that the distance between these positions is equal to a half magnitude of the motion vector v2.

In FIG. 3B, the position of the object O on the frame of the frame number "fr12" is estimated so that the object O moves from the position on the frame of the frame number "FR1" along the motion vector v1 so as to proceed the half magnitude of the motion vector V1. Similarly, the position of the object O on the frame of the frame number "fr23" is estimated so that the object O moves from the position on the frame of the frame number "FR2" along the motion vector v2 so as to proceed the half magnitude of the motion vector V2. It is noted that other estimations may be employed. For example, a position of the object O on the frame of the frame number "fr12" may be estimated so that the object O is present on the intermediate position between the positions on the frames of the frame numbers "FR1" and "FR2" by combining the frames of the frame numbers "FR1" and "FR2". Further, a position of the object O on the frame of the frame number "fr12" may be estimated so that the object O is present on the fourth part position between the positions on the frames of the frame numbers "FR1" and "FR3" by combining the frames of the frame numbers "FR1" and "FR3".

Thus, the interpolation is carried out using, not one frame, but instead plural frames when an image signal for output frame is generated, which reduces noise.

The frame frequency conversion unit 14 sequentially writes the input image signal f0 and the interpolation image signal f0.5 at a write frequency, and then alternately reads out the input image signal f0 and the interpolation image signal f0.5 at a double frequency of the write frequency, that is for a half one frame period of the input image signal f0. The frame frequency conversion unit 14 outputs an image signal illustrated in FIG. 2D with a double frame frequency of a frame frequency of the input image signal f0.

Figure 4A:
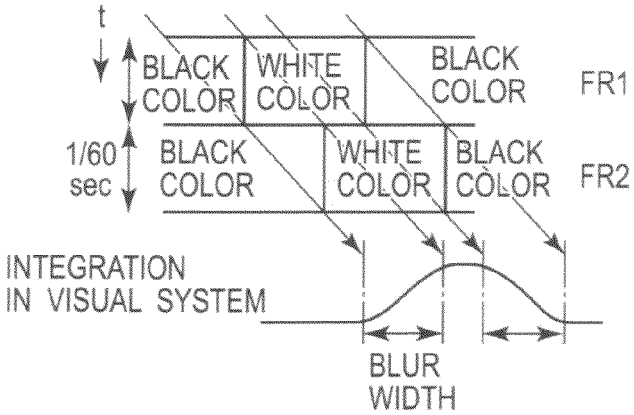
FIGS. 4A and 4B are explanatory diagrams to be employed to describe an effect of doubling a frame frequency.
Figure 4B:
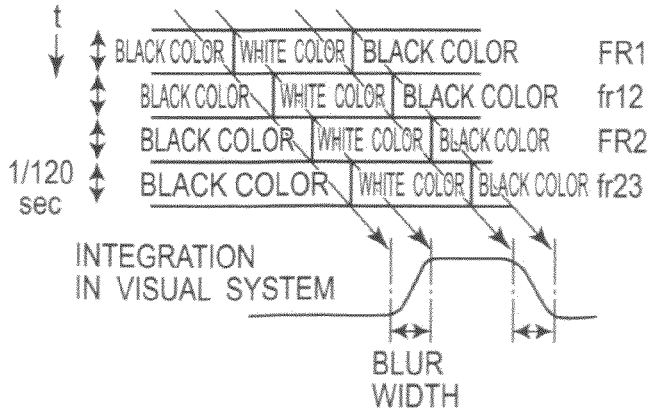

FIGS. 4A and 4B illustrate an effect of doubling a frame frequency. FIG. 4A shows a display state of frame images "FR1" and "FR2" under a condition where an image in which black color and white color are alternately arranged moves in a horizontal direction at a frame frequency 60 Hz. FIG. 4B shows a display state of frame images "FR1", "fr12", "FR2" and "fr23" under a condition where an image in which black color and white color are alternately arranged moves in a horizontal direction at a frame frequency 120 Hz.

In a region where white color (or black color) is changed into black color (or white color) when one frame is switched into another frame, which moves in a horizontal direction an image in which black color and white color are alternately arranged, a viewer looks the moving image of which the color change gently occurs (see FIGS. 4A and 4B). An integration function of human eye brings the gentle color change to appear. Thereby, blur widths shown in FIGS. 4A and 4B appears in the moving image. A blur width at the frame frequency 120 Hz is smaller than one at the frame frequency 60 Hz.

The area control unit 15 receives an image signal with a frame frequency doubled in the frame frequency conversion unit 14. The area control unit 15 includes a gain calculator 151 and a multiplier 152. The gain calculator 151 calculates a gain GV1 based on the image signal from the frame frequency conversion unit 14. The multiplier 152 multiplies the image signal from the frame frequency conversion unit 14 by the gain GV1 calculated in the gain calculator 151.

The area control in the present exemplary embodiment is a method for segmenting a liquid crystal panel and a backlight device into plural regions and then individually controlling light emitting luminance of the backlight by the respective segmented regions according to luminance information in an image signal. The backlight device is mounted on a back side of the liquid crystal panel. Under a condition where voltage applied states for respective pixels (liquid crystal display elements) mounted on the liquid crystal panel are controlled, the liquid crystal panel displays an image through pixels controlled such that light from the backlight device passes through the pixels.

Figure 5A:
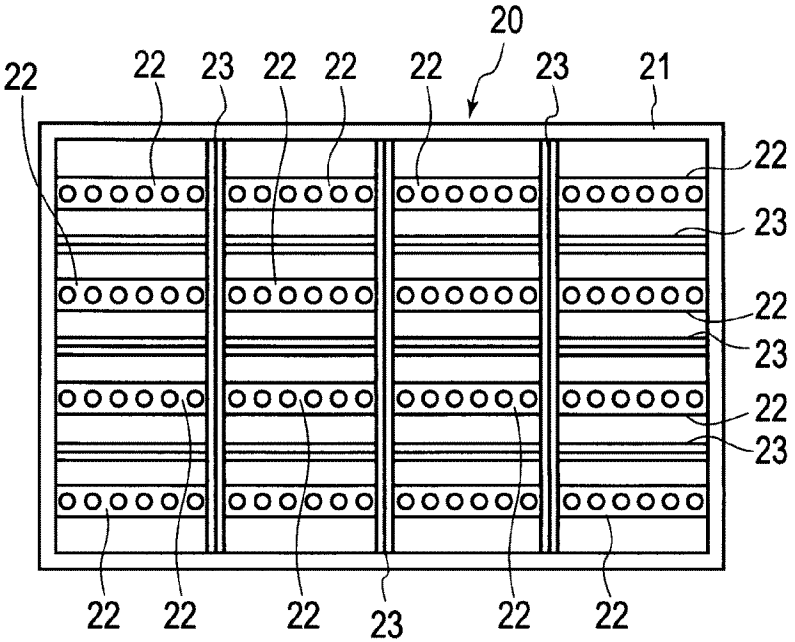
FIGS. 5A to 5C are configuration diagrams of a backlight device according to the first exemplary embodiment of the present invention.
Figure 5B:
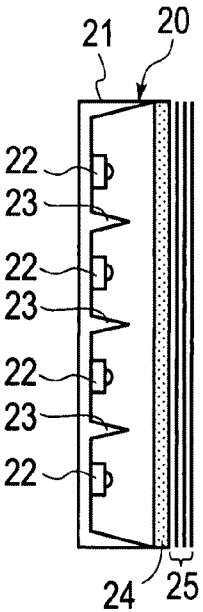
Figure 5C:
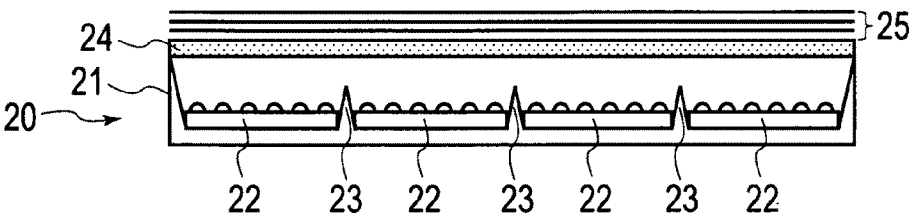

Here, one example configuration of the backlight device in the present exemplary embodiment will be described with reference to FIGS. 5A to 5C. FIG. 5A illustrates a front view of the backlight device 20. FIG. 5B illustrates a cross-sectional view of the backlight device 20 in a vertical direction of the backlight device 20. FIG. 5C illustrates a cross-sectional view of the backlight device 20 in a horizontal direction of the backlight device 20.

As shown in FIGS. 5A to 5C, the backlight device 20 has 16 segmented regions formed by segmenting the backlight device 20 in quarters in the vertical direction and in quarters in the horizontal direction. The backlight device 20 includes a housing 21 and light sources 22. The housing 21 is partitioned into 16 segmented regions via partition walls 23. Plural light sources 22 are arranged on each segmented region. A light-emitting diode (LED) is used as light source 22 in the present exemplary embodiment. It is noted that a cold cathode fluorescent lamp (CCFL) or an external electrode fluorescent lamp (EEFL) other than LED may be used as light source 22.

Light emitted from each light source 22 is diffused by a diffuser panel 24 mounted on an open front portion of the housing 21. A part of diffused light is slightly leaked into segmented regions, which are adjacent to a segmented region where each light source 22 is arranged, through space between the diffuser panel 24 and distal ends of the partition walls 23 which define the segmented region. A light amount control is carried out based on the leaked light. Three optical sheet assemblies 25 are attached on a front side of the diffuser panel 24. One optical sheet assembly 25 is formed by combining plural sheets for diffusing light such as a diffuser sheet, a prism sheet, and a brightness enhancement sheet called a dual brightness enhancement film (DBEF).

The liquid crystal panel is segmented in quarters in the vertical direction and in quarters in the horizontal direction, depending on 16 segmented regions formed on the backlight device 20, which forms 16 segmented regions on the liquid crystal panel. It is noted that the description "segmenting the liquid crystal panel into 16 segmented regions" means not that the liquid crystal panel is physically separated, but instead that 16 segmented regions are set on the liquid crystal panel. Each image signal to be supplied to the liquid crystal panel is processed as an image signal for a corresponding segmented region to be employed to display an image on the corresponding segmented region. Backlight luminance by the light sources 22 arranged on 16 segmented regions on the backlight device 20 is individually controlled on each segmented region.

How to segment the liquid crystal panel and the backlight device into plural regions is not limited to two-dimensional segmentation shown in FIG. 5A to 5C. For example, the liquid crystal panel and the backlight device may be segmented into plural regions only in the horizontal direction (one-dimensional segmentation).

The gain calculator 151 calculates a gain with respect to each image signal to be supplied to a corresponding segmented region of the liquid crystal panel because the liquid crystal panel is segmented into 16 segmented regions. It is assumed that a symbol "Gmax1" represents a maximum gradation in one frame period of an image signal to be supplied to each segmented region and a symbol "Gmax0" represents a maximum gradation to be determined depending on the number of bits in the image signal, the gain calculator 151 calculates a ratio "Gmax0/Gmax1" as gain GV1 by which an image signal to be supplied to each segmented region is multiplied in the multiplier 152.

An inverse of gain "Gmax1/Gmax0" is employed to control backlight luminance in a backlight luminance control unit (not shown). For example, if a value which is calculated by multiplying maximum luminance of light sources 22 on a corresponding segmented region of the backlight device 20 by the inverse of gain "Gmax1/Gmax0" is assumed as first light emitting luminance, and luminance of light to be emitted by a single light source 22 on the corresponding segmented region of the backlight device 22 in order to calculate the first light emitting luminance is assumed as second light emitting luminance, the second light emitting luminance is calculated by using an arithmetic expression for multiplying the first light emitting luminance by a coefficient set according to an amount of light which is emitted from the light sources 22 on the corresponding segmented region and then leaked into segmented regions other than the corresponding segmented region. Thereby, the backlight luminance control unit controls an amount of light to be emitted from the light sources 22 on the corresponding segmented region to the liquid crystal panel, to really emit light at a light amount calculated based on the second light emitting luminance, with respect to each segmented region on the backlight device 20.

The multiplier 152 multiplies an image signal after the frame frequency conversion, which is output from the frame frequency conversion unit 14, by the gain GV1 calculated in the gain calculator 151 on each segmented region, and then sends the multiplied image signal to the frame memory 16 and the overdrive unit 17 as an image signal fa which has been subjected to the area control processing. FIG. 2E illustrates an image signal subjected to the area control processing. For example, an image signal of a frame number "0.5*ac*" illustrated in FIG. 2E represents an image signal subjected to the area control processing with respect to an image signal of a frame number "0.5" illustrated in FIG. 2D from the frame frequency conversion unit 14.

The frame memory 16 holds one frame of an image signal subjected to the area control processing in the area control unit 15 during one frame period, and outputs the held one frame to the overdrive unit 17 as a delay image signal fb after the elapse of the one frame period (see FIG. 2F).

The overdrive unit 17 is a filter that emphasizes a rising edge of input image signal in a time axis direction. The overdrive unit 17 outputs an image signal fc defined by the following equation $fc=fa+k(fa-fb)$ . . . (1), where a variable "fa" is an image signal from the area control unit 15, a variable "fb" is a delay image signal from the frame memory 16, a coefficient "k" is a gain coefficient. The gain coefficient K is a coefficient for determining a degree of emphasis of image signal and set according to a response characteristic of the liquid crystal display element. The gain coefficient K is set to be small when a response speed is high to reduce an image lag. The gain coefficient K is set to be large when a response speed is low to increase an image lag.

FIG. 2G illustrates an image signal fc from the overdrive unit 17. For example, an image signal of a frame number "0.5*ac_od*" illustrated in FIG. 2G represents an image signal subjected to overdrive processing with respect to an image signal "fa" of a frame number "0.5*ac*" illustrated in FIG. 2E from the area control unit 15. Even if the overdrive unit 17 carries out time axis emphasis processing, the overdrive unit 17 can output the image signal fc in which an unintended fake contour of object and an unintended blur of moving image rarely occurs, because the image signals fa and fb to be input into the overdrive unit 17 are image signals subjected to the area control processing. The image signal fc is supplied to pixels (liquid crystal display elements) of the liquid crystal panel (not shown).

Next, effects of the area control and the overdrive according to the present exemplary embodiment will be described with reference to FIGS. 6A to 6C.

Figure 6A:
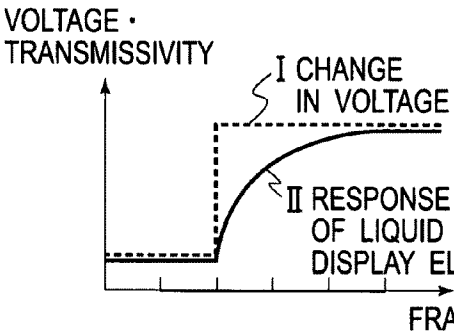
FIGS. 6A to 6C are explanatory diagrams to be employed to describe effects of area control and overdrive of the image display device shown in FIG. 1.

FIG. 6A illustrates a change in voltage of an image signal from the frame frequency conversion unit 14 and a response characteristic (transmissivity-to-temporal characteristic) of the liquid crystal display element corresponding to the change in voltage of the image signal, when an image signal having a change in frame from a black color image to a white color image is input into the frame frequency conversion unit 14. Even if a voltage of image signal from the frame frequency conversion unit 14 sharply rises in stepwise manner (see a dotted line I in FIG. 6A), a response characteristic of the liquid crystal display element to which the image signal is directly input smoothly rises (see a solid line II in FIG. 6A).

Figure 6B:
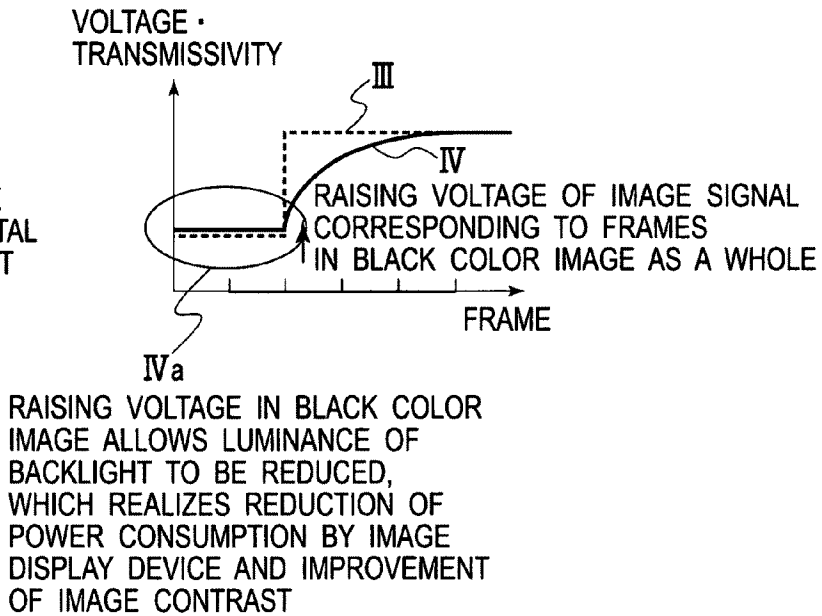

FIG. 6B illustrates a change in voltage of an image signal from the area control unit 15 and a response characteristic (transmissivity-to-temporal characteristic) of the liquid crystal display element corresponding to the change in voltage of the image signal, when the image signal having the rising in stepwise manner illustrated in the dotted line I in FIG. 6A is input into the area control unit 15. A voltage of image signal from the area control unit 15 sharply rises in stepwise manner (see a dotted line III in FIG. 6B), depending on the image signal from the frame frequency conversion unit 14. It is noted that a voltage of image signal corresponding to frames in the black color image is raised as a whole (see an ellipsoid IVa in FIG. 6B) because the image signal is multiplied by the gain GV1 in the area control processing.

Thus, the response characteristic of the liquid crystal display element to which the image signal is directly input represents a high transmissivity during a period for frames in the back color image (see the ellipsoid IVa in FIG. 6B). It is noted that, when the voltage of image signal corresponding to frames in the black color image is raised as a whole in the area control processing, the backlight device is controlled so as to reduce luminance of backlight, which realizes a reduction of power consumption by the image display device and an improvement of image contrast. However, even if a voltage of image signal from the area control unit 15 sharply rises in stepwise manner (see the dotted line III in FIG. 6B), a response characteristic of the liquid crystal display element to which the image signal is directly input smoothly rises (see a solid line IV in FIG. 6B).

Figure 6C:
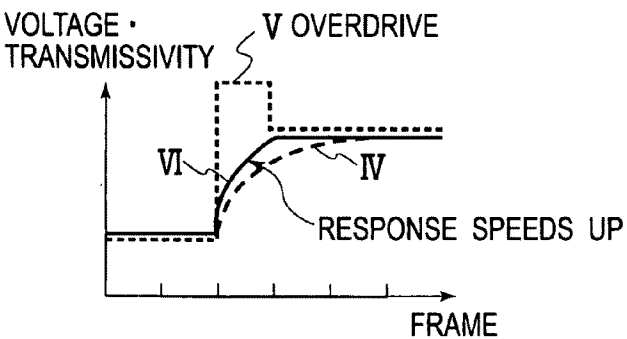

FIG. 6C illustrates a change in voltage of an image signal from the overdrive unit 17 and a response characteristic (transmissivity-to-temporal characteristic) of the liquid crystal display element corresponding to the change in voltage of the image signal, when the image signal having the rising in stepwise manner illustrated in the dotted line III in FIG. 6B is input into the overdrive unit 17. A voltage of image signal from the overdrive unit 17 has a change range where a voltage of image signal from the overdrive unit 17 more sharply rises in stepwise manner than a voltage of image signal from the area control unit 15 in the rising edge, and the rising voltage level is held for a predetermined period, by the emphasis processing in the time axis direction in the overdrive unit (see a dotted line V in FIG. 6C).

Thus, the response characteristic of the liquid crystal display element to which the image signal is directly input speeds up in rising (see a solid line VI in FIG. 6C), in comparison with the response characteristic at a time of carrying out no emphasis processing in the time axis direction in the overdrive unit 17 (see a long dotted line IV in FIG. 6C). It is noted that the long dotted line IV in FIG. 6C is the same as a solid line IV in FIG. 6B. This prevents an image lag from occurring in a displayed image on the liquid crystal display element.

Although the frame frequency of the input image signal f0 is doubled by generating one interpolation image signal f0.5 between the adjacent input image signals f0 in the present exemplary embodiment, the frequency conversion processing is not limited to it. For example, the frame frequency of the input image signal f0 may be m-times by m−1 interpolation image signals f0.5 between the adjacent input image signals f0.

Second Exemplary Embodiment

Figure 7:
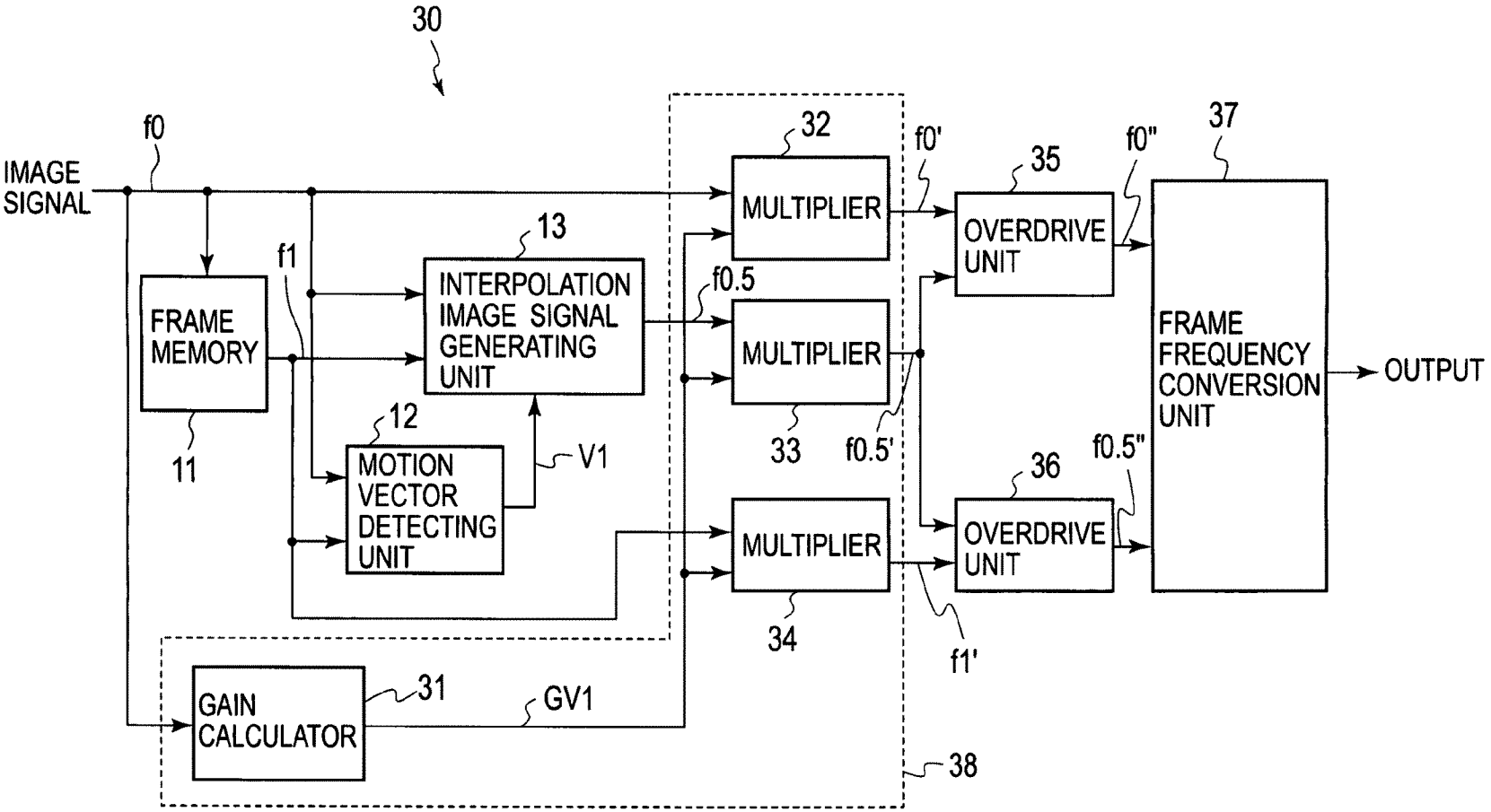
FIG. 7 is a block diagram of an image display device according to a second exemplary embodiment of the present invention.

FIG. 7 illustrates a block diagram of an image display device 30 according to the second exemplary embodiment. In FIG. 7, the same reference number as FIG. 1 is assigned to the same unit as FIG. 1, and the description of the same unit is omitted. The image display device 30 includes the frame memory 11, the motion vector detecting unit 12, the interpolation image signal generating unit 13, overdrive units 35 and 36, a frame frequency conversion unit 37 and an area control unit 38. The area control unit 38 includes a gain calculator 31 and multipliers 32, 33 and 34.

The image display device 30 is a liquid crystal display device provided with pixels arranged in matrix state and configured to send an output image signal from the frame frequency conversion unit 37 to an active matrix type liquid crystal panel (not shown), which holds an electric signal for a predetermined period by each pixel to carry out display, and then display an image on the liquid crystal panel. The pixels include liquid crystal display elements. A backlight device is mounted on a back side of the liquid crystal panel and has light sources for emitting light to the liquid crystal panel that are arranged on each corresponding segmented region.

Since the image display device 10 according to the first exemplary embodiment is needs two frame memories 11 and 16 each in which a matrix size is relatively large, the whole size of image display device 10 is relatively large. Further, since the overdrive unit 17 according to the first exemplary embodiment carries out the overdrive processing with respect to an image signal with high frequency after the frame frequency conversion in the frame frequency conversion unit 14, a speed of access to the memory for writing and reading a frame image to be employed to compare at least two frames in the overdrive processing increases, which burdens the image display device 10 with the overdrive processing. In contrast, a circuit scale of the image display device 30 according to the present exemplary embodiment is smaller than the image display device 10, which reduces the burden for the overdrive processing.

The gain calculator 31 calculates a gain GV1 by each image signal to be supplied to a corresponding segmented region on the liquid crystal panel based on an input image signal f0. The multiplier 32 multiplies the input image signal f0 by the gain GV1 calculated in the gain calculator 31 and outputs an image signal f0'. The multiplier 33 multiplies an interpolation image signal f0.5 from the interpolation image signal generating unit 13 by the gain GV1 calculated in the gain calculator 31 and outputs an image signal f0.5'. The multiplier 34 multiplies a delay image signal f1 from the frame memory 11 generated by delaying the input image signal f0 for one frame period by the gain GV1 calculated in the gain calculator 31 and outputs an image signal f1'.

Each of the overdrive unit 35 and 36 generates a signal represented by the equation (1) described in the first exemplary embodiment using two input signal. More specifically, the overdrive unit 35 carries out overdrive processing with respect to the image signal f0' from the multiplier 32 based on the image signal f0.5 from the multiplier 33, and then outputs an image signal f0". The overdrive unit 36 also carries out overdrive processing with respect to the image signal f0.5' from the multiplier 33 based on the image signal f1' from the multiplier 34, and then outputs an image signal f0.5". The frame frequency conversion unit 37 receives the image signal f0" and the image signal f0.5" and alternately outputs the image signal f0.5" and the image signal f0" in this order by half frame period, which generates a signal of which a frame frequency is doubled. Then, the frame frequency conversion unit 37 outputs the signal to the liquid crystal panel.

Next, an action of the image display device 30 will be described with reference to FIGS. 8A to 8I. The frame memory 11 stores the input image signal f0 illustrated in FIG. 8A in frame, and then outputs to the motion vector detecting unit 12 and the interpolation image signal generating unit 13 a delay image signal f1 illustrated in FIG. 8B delayed for one frame period. It is noted that each integer "0", "1", "2", "3" or "4" assigned to each frame shown in FIGS. 8A and 8B represents a number (frame number) of corresponding frame.

The motion vector detecting unit 12 detects a motion vector V between adjacent frames using the conventional matching method based on the input image signal f0 and the delay image signal f1, and sends the detected motion vector V to the interpolation image signal generating unit 13.

Figures 8A, 8B, 8C, 8D, 8E, 8F, 8G, 8H, 8I:
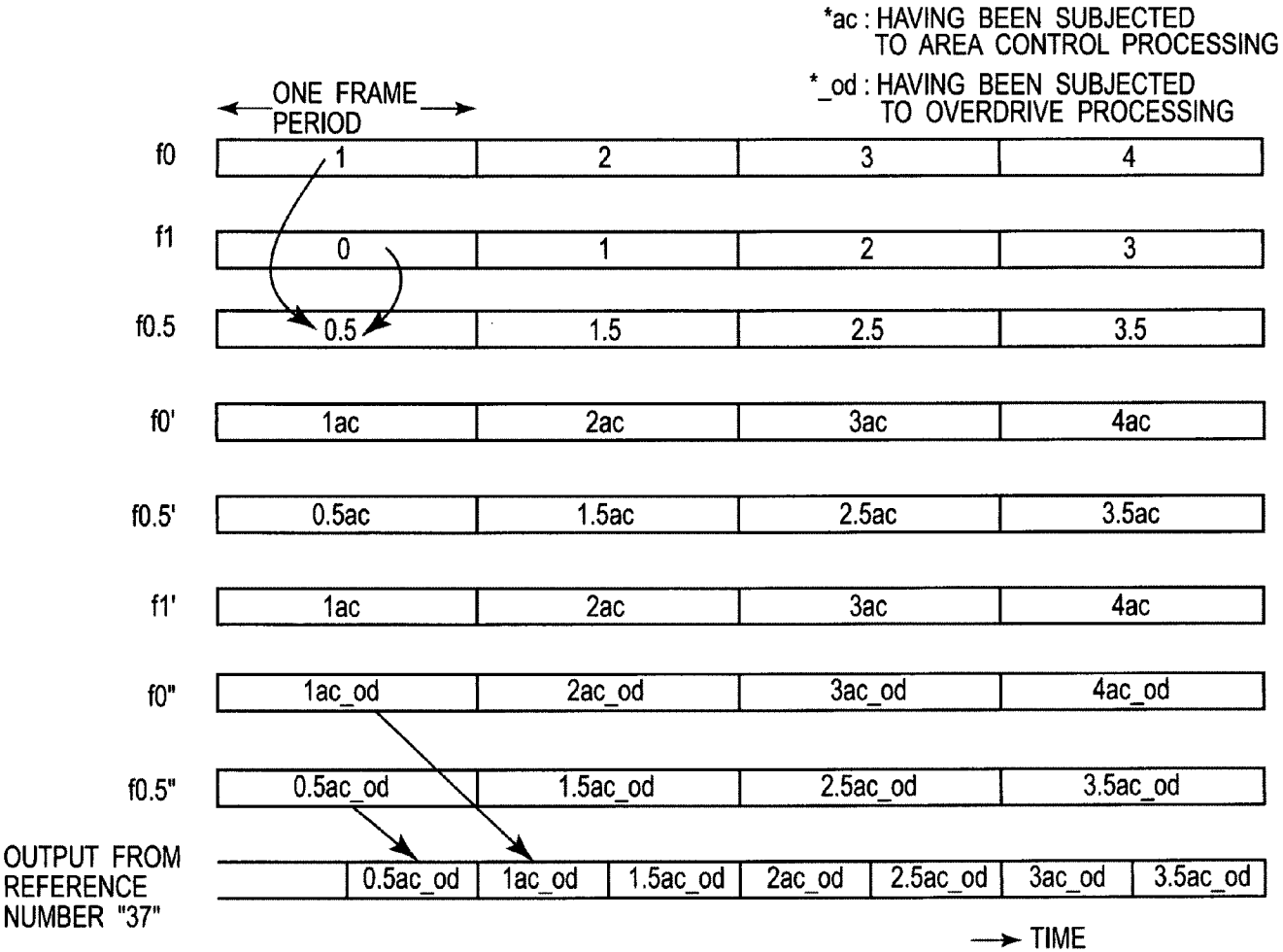
FIGS. 8A to 8I are timing charts to be employed to describe an action of the image display device shown in FIG. 7.

The interpolation image signal generating unit 13 carries out motion compensation interpolation processing with reference to the motion vector V to generate an interpolation image signal f0.5 illustrated in FIG. 8C based on the input image signal f0 and the delay image signal f1 and sends the generated interpolation image signal f0.5 to the multiplier 33.

As well as the gain calculator 151 according to the first exemplary embodiment, it is assumed that a symbol "Gmax1" represents a maximum gradation in one frame period of an image signal f0 to be supplied to each segmented region and a symbol "Gmax0" represents a maximum gradation to be determined depending on the number of bits in the image signal f0, the gain calculator 151 calculates a ratio "Gmax0/Gmax1" as gain GV1 by which an image signal to be supplied to each segmented region is multiplied in each of the multipliers 32, 33 and 34. An inverse of gain "Gmax1/Gmax0" is employed to control backlight luminance in a backlight luminance control unit (not shown).

The multiplier 32 multiplies the input image signal f0 by the gain GV1 calculated in the gain calculator 31 on each segmented region, and then sends the multiplied image signal to the overdrive unit 35 as an image signal f0' which has been subjected to the area control processing. FIG. 8D illustrates the image signal f0' subjected to the area control processing.

The multiplier 33 multiplies the interpolation image signal f0.5 by the gain GV1 calculated in the gain calculator 31 on each segmented region, and then sends the multiplied image signal to the overdrive units 35 and 36 as an interpolation image signal f0.5' which has been subjected to the area control processing. FIG. 8E illustrates the interpolation image signal f0.5' subjected to the area control processing.

The multiplier 34 multiplies the delay image signal f1 by the gain GV1 calculated in the gain calculator 31 on each segmented region, and then sends the multiplied image signal to the overdrive unit 36 as a delay image signal f1' which has been subjected to the area control processing. FIG. 8F illustrates the delay image signal f1' subjected to the area control processing. For example, image signals of frame numbers "0.5*ac*" and "1*ac*" illustrated in FIGS. 8D, 8E and 8F represent image signals subjected to the area control processing.

The overdrive unit 35 receives the image signal f0' and the interpolation image signal f0.5' which have been subjected to the area control processing, and emphasizes a rising edge of the image signal f0' in a time axis direction (that is carrying out the overdrive processing) using the interpolation image signal f0.5' to generate an image signal f0". FIG. 8G illustrates the image signal f0" subjected to the overdrive processing. The overdrive unit 36 receives the delay image signal f1' and the interpolation image signal f0.5' which have been subjected to the area control processing, and emphasizes a rising edge of the interpolation image signal f0.5' in a time axis direction (that is carrying out the overdrive processing) using the delay image signal f1' to generate an interpolation image signal f0.5". FIG. 8H illustrates the interpolation image signal f0.5" subjected to the overdrive processing.

The frame frequency conversion unit 37 sequentially writes in a write frequency the image signal f0" and the interpolation image signal f0.5" which have been subjected to the overdrive processing, and then alternately reads out the images signal f0" and the interpolation image signal f0.5" in a double frequency of the write frequency. Thereby, the frame frequency conversion unit 37 outputs an image signal illustrated in FIG. 8I with a double frame frequency of a frame frequency of the input image signal f0 (a half one frame period of the input image signal f0) in which the interpolation image signal f0.5" and the images signal f0" are alternately combined in this order by the half one frame period of the input image signal f0. An effect of this frame frequency conversion is identical to the effect illustrated in FIGS. 4A and 4B. As well as the first exemplary embodiment, for example, image signals of frame numbers "0.5*ac_od*" and "1*ac_od*" illustrated in FIGS. 8G, 8H and 8I represent image signals subjected to the overdrive processing.

Next, effects of the area control and the overdrive according to the present exemplary embodiment will be described with reference to FIGS. 9A to 9C.

Figure 9A:
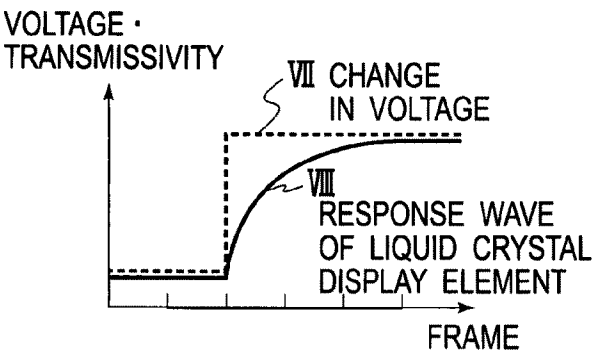
FIGS. 9A to 9C are explanatory diagrams to be employed to describe effects of area control and overdrive of the image display device shown in FIG. 7.

FIG. 9A illustrates a change in voltage of an interpolation image signal f0.5 from the interpolation image signal generating unit 13 and a response characteristic (transmissivity-to-temporal characteristic) of the liquid crystal display element corresponding to the change in voltage of the interpolation image signal f0.5, when an image signal having a change in frame from a black color image to a white color image is input into the interpolation image signal generating unit 13. Even if a voltage of interpolation image signal f0.5 from the interpolation image signal generating unit 13 sharply rises in stepwise manner (see a dotted line VII in FIG. 9A), a response characteristic of the liquid crystal display element to which the interpolation image signal f0.5 is directly input smoothly rises (see a solid line VIII in FIG. 9A).

Figure 9B:
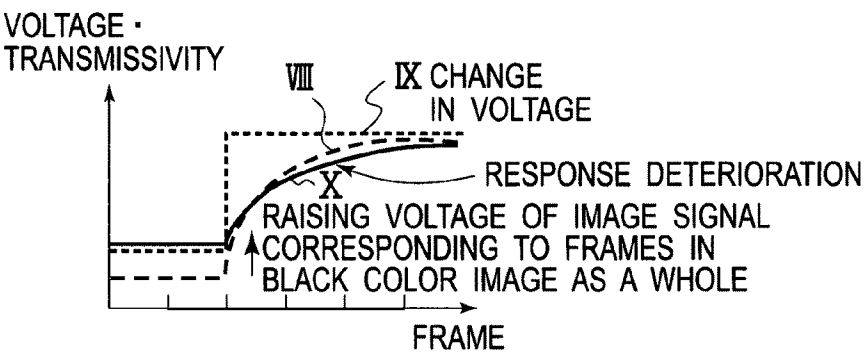

FIG. 9B illustrates a change in voltage of an interpolation image signal f0.5' from the multiplier 33 and a response characteristic (transmissivity-to-temporal characteristic) of the liquid crystal display element corresponding to the change in voltage of the interpolation image signal f0.5', when the interpolation image signal f0.5 having the rising in stepwise manner illustrated in the dotted line VII in FIG. 9A is input into the multiplier 33. A voltage of interpolation image signal f0.5' from the multiplier 33 sharply rises in stepwise manner (see a dotted line IX in FIG. 9B), depending on the interpolation image signal f0.5 from the interpolation image signal generating unit 13. It is noted that a voltage of image signal corresponding to frames in the black color image is raised as a whole because the image signal is multiplied by the gain GV1 in the area control processing. This means that the level of stepwise change in voltage of the interpolation image signal f0.5' is smaller than that in voltage of the interpolation image signal f0.5 (see FIGS. 9A and 9B).

Thus, the response characteristic of the liquid crystal display element to which the interpolation image signal f0.5' is directly input represents a further smooth rising, in comparison with the response characteristic VIII (see a solid line X in FIG. 9B). It is noted that, when the voltage of image signal corresponding to frames in the black color image is raised as a whole in the area control processing, the backlight device is controlled so as to reduce luminance of backlight, which realizes a reduction of power consumption by the image display device and an improvement of image contrast.

Figure 9C:
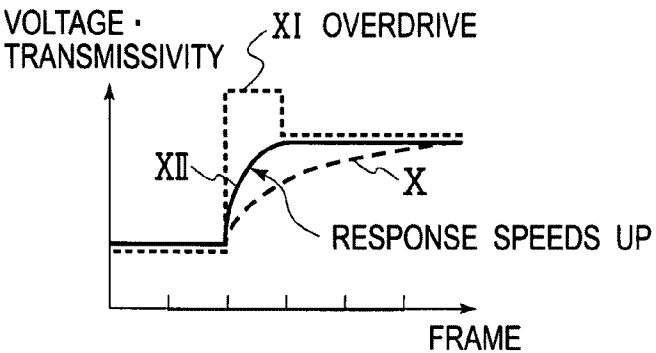

FIG. 9C illustrates a change in voltage of an image signal f0" generated in the overdrive unit 35 by emphasizing a rising edge of the image signal f0' in a time axis direction using the interpolation image signal f0.5' illustrated the dotted line IX in FIG. 9B. A voltage of image signal f0" has a change range where a voltage of image signal f0" more sharply rises in stepwise manner than a voltage of image signal f0' in the rising edge, and the rising voltage level is held for a predetermined period, by the emphasis processing in the time axis direction in the overdrive unit 35 (see a dotted line XI in FIG. 9C).

Thus, the response characteristic of the liquid crystal display element to which the image signal f0" is directly input speeds up in rising (see a solid line XII in FIG. 9C), in comparison with the response characteristic at a time of carrying out no emphasis processing in the time axis direction in the overdrive unit 35 (see a long dotted line X in FIG. 9C). It is noted that the long dotted line X in FIG. 9C is the same as the solid line X in FIG. 9B. This prevents an image lag from occurring in a displayed image on the liquid crystal display element.

The image display device 30 can reduce the burden for the overdrive processing, in comparison with the image display device 10 which carries out the overdrive processing after the frame frequency conversion, because the image display device 30 carries out the overdrive processing before the frame frequency conversion using the overdrive units 35 and 36, with respect to the image signals f0' and f0.5' with low frequency. Further the image display device 30 can decrease a speed of accessing a memory where the image display device writes or reads each frame image to be used for comparing at least two adjacent frames in the overdrive processing.

The image display device 30 can reduce a circuit scale in comparison with the image display device 10 because the number of frame memories is one (frame memory 11). It is noted that the circuit scale of one frame memory is remarkably larger than the circuit scales of three multipliers. Further, as well as the image display device 10, the image display device 30 can reduce the excessive emphasis and the deficient emphasis, which occur at a time when the area control processing is carried out after the overdrive processing, because the area control processing is carries out before the overdrive processing. This prevents a fake contour of object due to the excessive emphasis and a blur of moving image due to the deficient emphasis from occurring, which improves moving image characteristics and contrast.

Although the frame frequency of the input image signal f0 is doubled by generating one interpolation image signal f0.5 between the adjacent input image signals f0 in the present exemplary embodiment, the frequency conversion processing is not limited to it. For example, instead of the interpolation image signal generating unit 13, the multipliers 32 to 34 and the overdrive units 35 and 36, the image display device 30 includes one interpolation image signal generating unit configured to generate m−1 interpolation image signal f0.5 to be inserted between the adjacent input image signals f0, m+1 multipliers and m overdrive units, such that the frame frequency of the input image signal f0 is m-times.

What is claimed is:

1. An image display device comprising:

a liquid crystal panel that displays an image thereon based on an image signal;

a backlight device that is mounted on a back side of the liquid crystal panel and segmented into plural regions, and has light sources for emitting light to the liquid crystal panel which are arranged on each region;

a delay unit that delays a first image signal with a first frame frequency for one frame period to generate a second image signal;

an interpolation image signal generating unit that generates one or plural interpolation image signals to be inserted between adjacent frames in the first image signal, using the first image signal and the second image signal;

a gain calculator that calculates a gain based on a ratio of a maximum gradation in one frame period of the first image signal and a maximum gradation to be determined depending on the number of bits in an image signal, with respect to each region of the liquid crystal panel corresponding to the each region of the backlight device;

a first multiplier that multiplies the first image signal by the gain to generate the multiplied first image signal;

a second multiplier that multiplies the second image signal by the gain to generate the multiplied second image signal;

at least one multiplier that multiplies the one or plural interpolation image signals by the gain to generate the multiplied one or plural interpolation image signals;

an overdrive unit that carries out processing for emphasizing the multiplied first image signal and the multiplied one or plural interpolation image signals in a time axis direction, using the multiplied one or plural interpolation image signals and the multiplied second image signal adjacent to the multiplied first image signal and the multiplied one or plural interpolation image signals on time series, to generate a first image signal and one or plural interpolation image signal subjected to the emphasis processing; and a frame frequency conversion unit that inserts the one or plural interpolation image signals having been subjected to the emphasis processing between the adjacent frames in the first image signal having been subjected to the emphasis processing to generate an image signal with a second frame frequency higher than the first frame frequency.

2. The image display device according to claim 1, further comprising:

a control unit that controls the light sources arranged on each region of the backlight device such that the light sources emit light at a light amount depending on an inverse of the gain calculated by the gain calculator with respect to each region of the liquid crystal panel corresponding to the each region of the back light device.

* * * * *